United States Patent [19]

DeCaro

[11] Patent Number: 4,809,568

[45] Date of Patent: Mar. 7, 1989

[54] BARREL ASSEMBLY FOR INSTALLATION TOOL AND METHOD OF INSTALLATION

[75] Inventor: Charles J. DeCaro, Charlotte, N.C.

[73] Assignee: Demby Industries, Inc., Stanfield, N.C.

[21] Appl. No.: 184,196

[22] Filed: Apr. 21, 1988

[51] Int. Cl.[4] ..... B25B 23/02

[52] U.S. Cl. ..... 81/57.37; 81/435; 29/240; 227/149

[58] Field of Search ..... 81/51.37, 54, 431, 435; 29/240, 809; 227/111, 112, 120, 136

[56] References Cited

U.S. PATENT DOCUMENTS

| | | | |
|---|---|---|---|
| 3,973,605 | 8/1976 | DeCaro | 81/54 X |
| 4,018,254 | 4/1977 | DeCaro | 81/57.37 |
| 4,062,388 | 12/1977 | DeCaro | 81/57.37 |
| 4,091,850 | 5/1978 | Kjolsrud | 81/57.37 X |
| 4,295,394 | 10/1981 | DeCaro | 81/57.37 |
| 4,375,119 | 3/1983 | DeCaro | 81/435 X |
| 4,646,596 | 3/1987 | Edwards et al. . | |
| 4,653,360 | 3/1987 | Compton . | |
| 4,672,550 | 6/1987 | Winterbottom et al. . | |
| 4,709,842 | 12/1987 | Westurlund | 227/120 |

*Primary Examiner*—James G. Smith

*Attorney, Agent, or Firm*—Webb, Burden, Ziesenheim & Webb

[57] ABSTRACT

A barrel assembly includes a housing for attachement to a conventional driving tool. A barrel member having a through bore is slidably attached at one end to the housing and carries a stress plate retaining pad at the other end. A pre-assembled enlongated headed fastener and stress plate combination is inserted into the barrel assembly whereby, during driving, the head of the fastener is slidably guided by the barrel bore while the shank portion of the fastener is rigidly held by the locked stress plate assuring a perpendicular driving alignment between the fastener and the workpiece, such as a roof deck plate. Biasing means normally forces the barrel in an extended position relative to the housing and also permits the barrel and stress plate retaining pad to retract during a plate tapping sequence of the fastener to prevent thread stripping of the stress plate.

9 Claims, 4 Drawing Sheets

BARREL ASSEMBLY FOR INSTALLATION TOOL AND METHOD OF INSTALLATION

BACKGROUND OF THE INVENTION

The invention relates generally to fastener installation tools and, more particularly, to an improved barrel assembly for a driver tool and a method for driving and setting fastener and plate combinations which afford superior fastener alignment and resultant improved distribution of plate stresses.

Heretofore, many diverse tools have been developed for driving a variety of fasteners into workpieces. The intended use of the driving tool often defines problems which require unique solutions. One such application requiring special driving tools is the installation of insulation on metal roof decks. The insulation is normally held to the roof deck by means of enlarged washer-like plates or discs of plastic or metal through which an elongated, threaded fastener or nail type fastener extends. These discs are often referred to as stress plates. The insulation may be six inches thick or more and, therefore, the fastener often approaches seven or eight inches, or longer, and must be held in perpendicular alignment so that it properly penetrates the insulation and the metal roof deck. In order to accomplish this feat, the elongated fastener must be loaded into the tool and a proper alignment of the fastener and the stress plate must also be achieved. Proper alignment is possible only if the setting tool provides means for holding the plate in proper relationship with the fastener.

In such environments, the loading and alignment of elongated fasteners and the handling thereof has been a constant area of concern. A number of fastener entrant means has been proposed heretofore. In my U.S. Pat. No. 3,973,605, I disclose a breach-type barrel assembly which opens in the manner of a shotgun to provide a hand fed fastener. In my U.S. Pat. No. 4,081,254, I disclose a barrel assembly in which a strip carrying fastener passes through slots in the wall of the barrel to sequentially place the fasteners within the barrel bore. Others have heretofore provided entrant means in barrel assemblies wherein the fastener is hand fed through appropriate slots in the barrel wall into the barrel bore. Exemplary of these patents are U.S. Pat. Nos. 2,845,968; 2,484,655; and Netherlands Pat. No. 51,874.

A number of power operated screwdrivers include automatic means of feeding fasteners. Exemplary of these are U.S. Pat. Nos. 3,907,014; 3,524,484; 2,922,447; and 2,327,074. Several of the above patents also teach various means such as jaw assemblies for holding the fastener in alignment at the time of installation. Other patents teaching means for holding the fastener within the barrel at the time of installation include U.S. Pat. Nos. 3,056,441; 1,889,330; and 3,226,537. In the main, the various tools disclosed in the above patents are not suitable for handling extremely long fasteners in which alignment is also critical. A commonly used tool for installing insulation on a roof deck includes a tube feed device. However, the incidents of bowed fasteners increases with fastener length and this in turn causes jamming within the tube feed. In addition, the barrel must be extremely long to accommodate a fastener fed at an angle to the barrel. Because of the required length of the barrel assemblies, the overall weight is increased. The combination of height and weight make the tool impractical to use particularly when alignment is of concern and plate-holding type of tools are necessary which require the lifting of the tool and flipping it over to be able to attach the plate to the tool.

In my U.S. Pat. No. 4,295,394, I disclose a retractable barrel assembly for an installation tool primarily intended for the installation of long fasteners through insulation and into a roof deck. The barrel assembly disclosed therein is particularly suited for installation of separate elongated fasteners and stress plates disclosed in my U.S. Pat. No. 4,361,997. In the aforementioned patent, the barrel assembly includes an entrant means for separate insertion of the elongated , fastener into the interior of the barrel bore. The entrant means is an elongated slot in the barrel wall which increases in depth along its length from a starting point and terminates in an enlarged clear through opening in registry with the bore. The retractable barrel cooperates with an inner sleeve and includes a clear through notch in registry with the elongated slot to receive the fastener in the barrel bore. A spring loaded jaw assembly is also included in a workpiece pad at the end of the barrel to slidably engage a wear plate and provide alignment for the fastener shaft as it is being driven into the hub portion of a stress plate which is held in position beneath the work pad. Pressure may be applied by a foot pad attached to the work pad. While the aforementioned barrel assembly represents a significant improvement over prior devices, there are still problems present. The jaw assemblies must be "spring" or "elastically" loaded to permit the head of the fastener to pass through the barrel. In addition, individual fasteners are sometimes lost or remain on the roof surface after the installation sequence has been completed. In such cases, the fasteners are later discovered only after the final plastic coating has been applied over the insulation resulting in an unsightly appearance and a potential site for leakage. The barrel assembly is formed in three retractable sections and is rather long and somewhat cumbersome to handle. The barrel is also moderately expensive to manufacture due to the close machining tolerances required for proper keying and slotting required for registry of parts so as to ensure trouble free insertion of the loose fasteners. True perpendicular alignment between the elongated fastener and the stress plate has also sometimes created difficulties. Thread stripping of the stress plate hub has also been a problem with this prior tool since the work pad holding the stress plate is fixed relative to the workpiece. In my U.S. Pat. No. 4,375,119, there is disclosed a floating barrel assembly which is suitable for use in conjunction with the device described in my aforementioned U.S. Pat. No. 4,295,394 to eliminate the thread stripping problem in the long barrel configuration. The subject barrel assembly, however, still requires a workpiece pad with a foot rest to ensure contact between the pad and the workpiece during the driving operation and is relatively complex in construction.

Finally depth control is also important since overdriving the fastener causes undue stress on the plates, an improperly lined fastener which is overdriven increases the likelihood of a cracked plastic plate. Even with proper aligning, overdriving can cause reverse bowing of the plate which is a potential hazard to the single ply membrane placed over the insulation. Existing tools may result in any one or more of the following: (1) reduced productivity; (2) lack of flexibility in adapting to job situation; (3) high costs and (4) maintenance problems.

SUMMARY OF THE INVENTION

I have now invented an improved barrel assembly and a method of driving and fixing threaded elongated fastener and stress plate combinations presently used in the installation of insulation on metal roof deck. The present invention provides a barrel assembly for attachment to the end of a conventional driving tool which has an overall substantially decreased length than that of my previous barrel assembly. One aspect of the present invention provides a method of installing an elongated threaded fastener and stress plate combination which is more efficient and faster than prior fastening methods while also providing positive alignment of the driven combination. The fastener parts are easier to handle and load into my improved barrel assembly with little or no opportunity for lost or errantly placed loose fasteners which could later cause cracking of the top membrane.

My invention further provides a barrel assembly for use in conjunction with a conventional driving tool which is lighter in weight and less cumbersome to operate than prior devices of this type. Because the apparatus of the invention utilizes pre-assembled fastener and stress plate combinations, the barrel assembly is significantly shorter in length and is less complex to manufacture since there is no requirement to feed loose fasteners into the barrel bore. In addition, smaller insertion forces are applied to the present barrel assembly which permits the use of plastic materials in several of the major structural components thereof. Further spring loaded jaws are not necessary.

Briefly stated, a pre-assembled fastener-stress plate is employed wherein the stress plate forms a part of the tool during installation and then is removed from the tool upon completion of installation. The apparatus of the present invention is directed to a barrel assembly for attachment to a conventional driving tool of the type which includes a tool body and a rotatable driver element, such as, for example, a screwdriver head. The barrel assembly includes a cylindrically-shaped housing having a through bore adapted for attachment at one end to the tool body. A barrel having a first end, a second end and a through bore is slidably connected at its first end within the bore of the housing. A biasing means, such as a coil spring, is associated with the barrel and the housing to urge the barrel into an extended position. The second end of the barrel carries a stress plate retaining member which is adapted to receive and hold a pre-assembled stress plate and headed fastener combination therein. In use, the bore of the barrel is adapted to slidably engage and guide the head of the fastener while the shaft portion of the fastener is rigidly held in place by the locked stress plate. The barrel and housing may be constructed of an appropriate plastic material such as a glass-filled nylon. In order to provide additional wear resistance, a steel tube insert may be molded along with the barrel to form the internal bore thereof. Stress plate retention and rotational resistance means in the form of locking fins or tabs, for example, may be provided around the perimeter of the plate retaining member. A depth gauge adjustment is also provided.

Briefly, according to the present invention a method of driving a stress plate and elongated threaded fastener into a workpiece is provided, comprising the steps of pre-assembling a threaded fastener into a hub portion of the stress plate to a predetermining spatial relationship between the fastener head and the top of the plate; then inserting the pre-assembled stress plate and fastener into a driver tool such that the plate becomes fixed with respect to the tool and the fastener is maintained in an aligned position; driving the fastener into the workpiece while maintaining the fastener and plate in an aligned position; and finally removing the tool from the driven fastener and stress plate. The pre-assembled fastener and plate can be muzzle loaded, side loaded or preset into the insulation in which case the tool is inserted over the fastener and locked onto the plate.

DETAILED DESCRIPTION OF THE PREFERRED EMBODIMENTS

Figure 1:
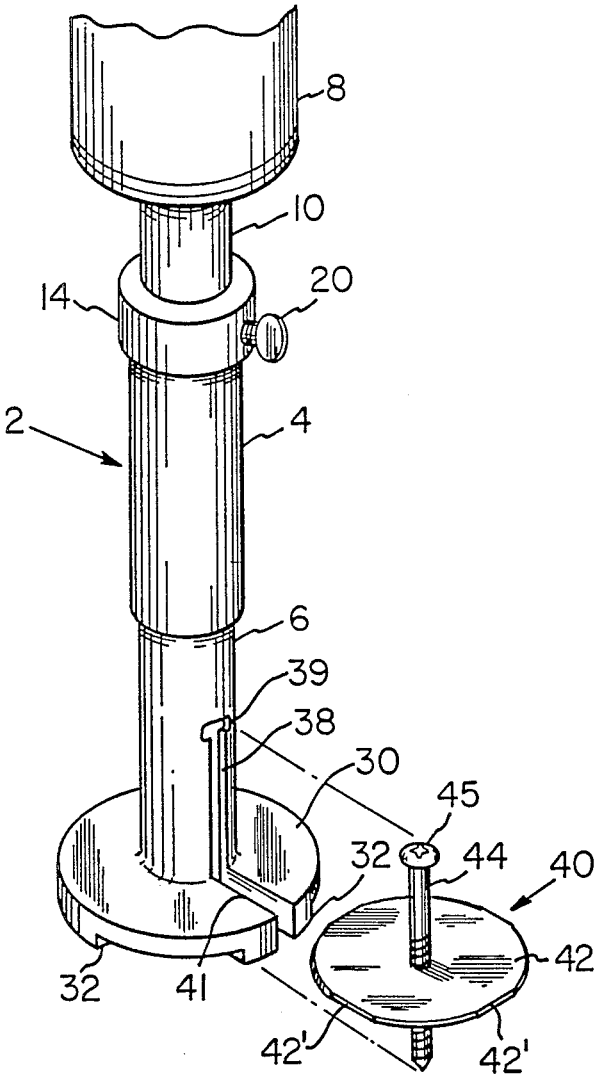
FIG. 1 is a perspective view of the barrel assembly of the present invention attached to a partially shown driving tool with an elongated threaded fastener and stress plate combination shown in a side insertion position next to the barrel.

Referring now to the drawings, the barrel assembly of the present invention is designated generally by reference numeral 2. The barrel assembly 2 is adapted for attachment to a conventional driving tool 8 by way of an elongated threaded neck portion 10 carried by the tool 8 and shown in FIG. 1. Driving tool 8 is well known in the art and is employed to drive fasteners and stress plate combinations of the type indicated generally by the reference numeral 40. Fastener and stress plate combinations 40 are driven into a workpiece such as, for example, an insulated metal roof deck 50, shown in FIGS. 12–14.

Figure 2:
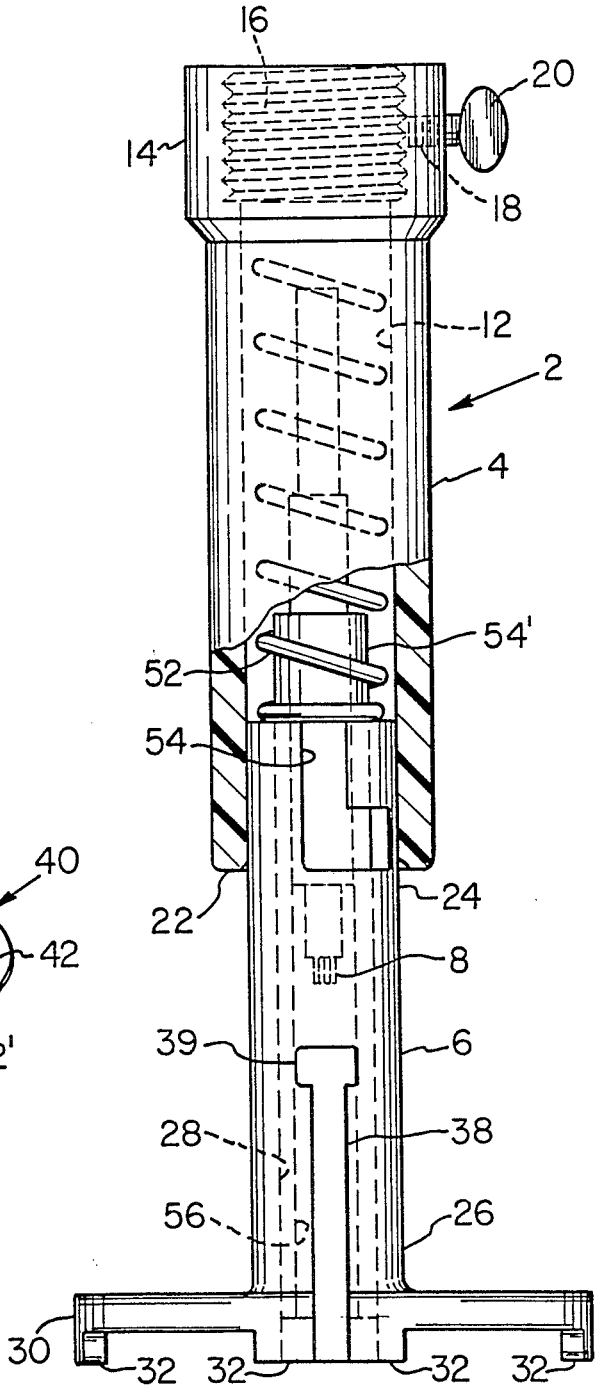
FIG. 2 is a partially cut-away side elevation view of the barrel assembly of the present invention.
Figure 3:
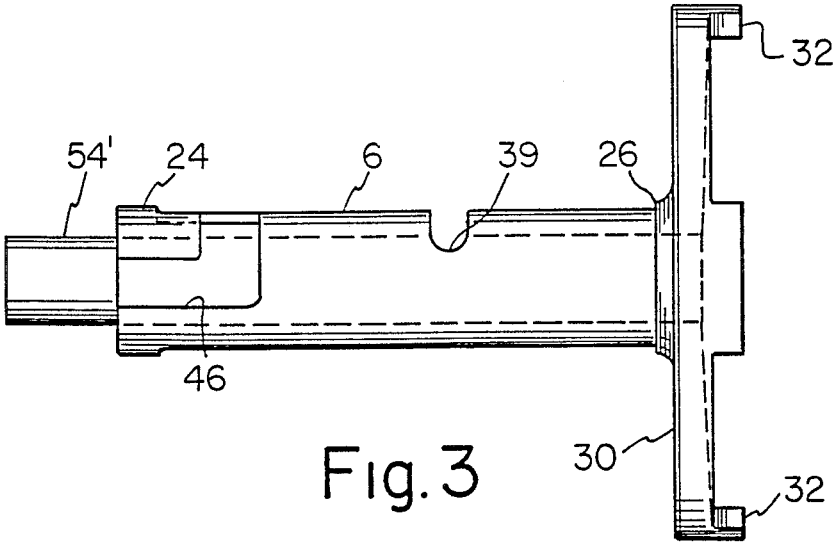
FIG. 3 is a side elevation view of the barrel member.
Figure 4:
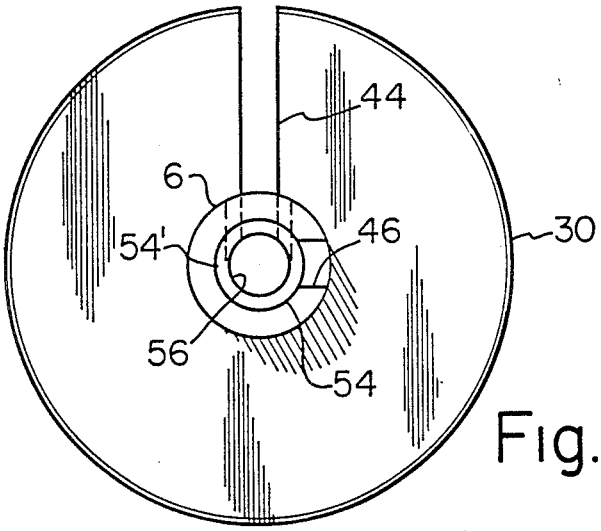
FIG. 4 is a top plan view of the barrel member.
Figure 9:
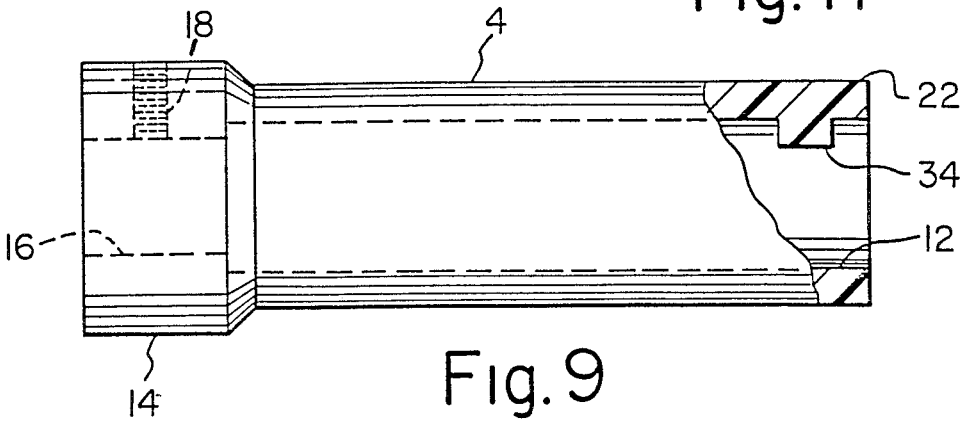
FIG. 9 is a partially fragmented side elevation view of the housing member.

As seen in FIG. 2, the barrel assembly 2 includes a cylindrically-shaped housing 4 having a first end 14 which is adapted to be connected to the previously described neck portion 10 of the driving tool 8. The first end 14 of the housing may include a threaded bore portion 16 for connection to the threaded neck portion 10 of the driving tool. A thumb screw 20 is threadably secured within the first end 14 by way of a threaded bore 18 formed therethrough. Rotation of the thumb screw 20 causes the end of the screw 20 to contact the side of the neck portion 10 of the driving tool 8 so as to lockingly engage the barrel assembly 2 and prevent relative movement therebetween. This forms a depth adjustment for the fastener since the position of the barrel assembly is adjustable relative to the tool which carries the driver. As seen in FIGS. 2 and 9, the housing 4 also has a through bore 12 which extends from the first end 14 to a second end 22. The housing 4 may be constructed of a metal such as steel or it may be molded from a high impact plastic, such as a glass-filled nylon material. Housing 4 also carries an integral lug 34 formed adjacent the second end 22 and extending into the bore 12, the function of which will be explained hereinafter.

Figure 8:
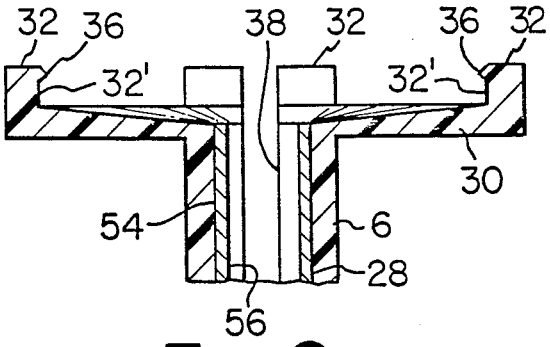
FIG. 8 is a partial sectional view taken along line VIII—VIII of FIG. 7.

A barrel member 6 is retractably connected to the housing 4 as perhaps best seen in FIG. 2 and is adapted to slidably move in an axial direction within the housing bore 12. The barrel 6 includes a first end 24 which is fitted within the bore of housing 4 and a second end 26 which carries a stress plate retaining or holding member 30 thereon. The plate retaining member 30 is generally circular in plan view and preferably includes a plurality of spaced apart locator projections 32 which permit the placement of a stress plate 42 of the preassembled disc and fastener combination 40 therein as shown in FIG. 8. At least one and preferably two of the projections 32 may contain outwardly projecting locking tabs or fins 36 which are adapted to engage portions of the outer periphery of the stress plate 42 so as to hold the assembly 40 within the plate holder 30 of barrel assembly 2 during the driving operation shown in FIGS. 12–14. The barrel portion 6 also has a through bore 28 formed therein which communicates with the bore 12 of the housing to permit the entry of the fastener 44 as well as the fastener driver head 45 of the tool 8 therein. Barrel 6 also preferably contains a slot 38 formed in its sidewall and communicating with the bore 28 to permit the side insertion of a fastener plate combination 40 into the barrel assembly 2. The slot 38 also includes an enlarged head portion 39 to permit passage of the head 45 of the fastener therethrough, FIG. 1. The plate holder member 30 also has a slot 41 formed therein to permit the passage of the shank of the fastener 44 therethrough. The fastener plate combination 40 can thus be loaded in a lateral, sideway fashion through the slots 38 and 41 or it can be directly inserted from beneath (muzzle loaded) wherein the fastener portion 44 is slid directly into the barrel bore 28 and the stress plate portion 42 easily snaps into registry with the projections 36 of the plate retaining member 30. Thus the tool can also be inserted over a pre-assembled fastener-plate which has been manually placed in the insulation at appropriate locations. The inserted fastener plate combination 40 is then ready to be driven into a workpiece, the details of which will be explained in greater detail hereinafter.

The outer side wall of the barrel 6 also has a J-shaped slot 46 formed therein which forms a bayonet-type locking arrangement with the lug 34 of the housing 4. A longitudinally extending slot 48 is also formed in the side wall of the barrel 6 and is in communication with the J-shaped slot 46 to permit the entry of lug 34 thereinafter the bayonet-type lock is established. After locking, the lug 34 slidably travels in an axial direction within the slot 48 and acts as an alignment or travel guide to permit and limit the retractable sliding movement between the barrel 6 and the housing 4. Rotation of the barrel is likewise prevented by the lug 34.

Figure 12:
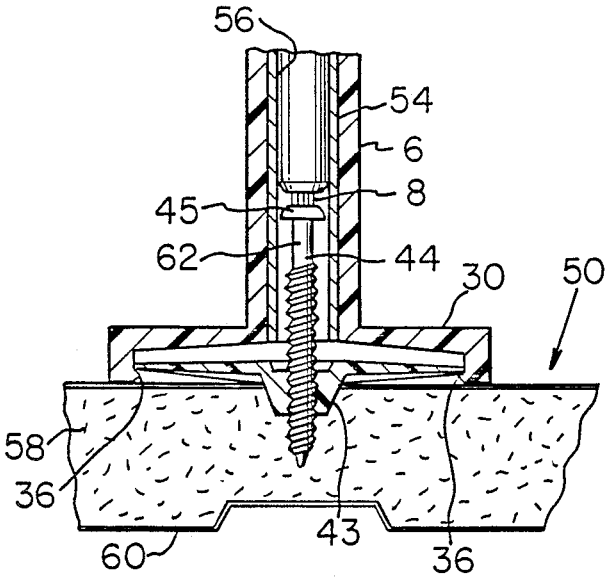
FIG. 12 is a partial cross-sectional view of the barrel assembly with a fastener and stress plate being driven into a insulated roof.
Figure 13:
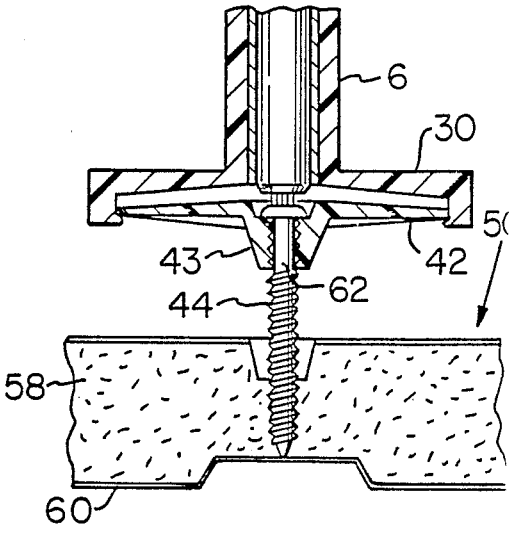
FIG. 13 is a view similar to FIG. 12 showing the threaded fastener in a position where it is commencing penetration of a metal roof deck.
Figure 14:
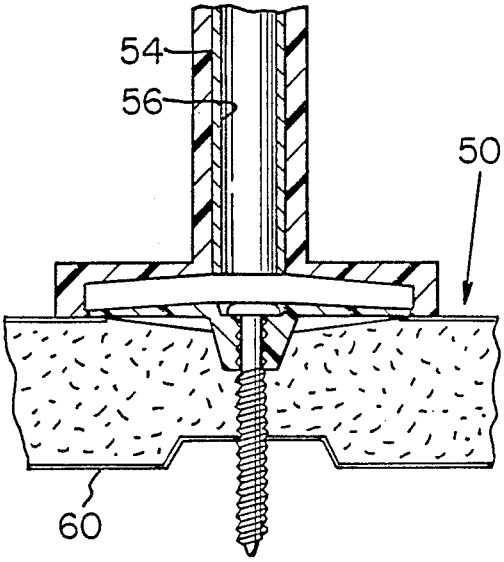
FIG. 14 is a view similar to FIGS. 12 and 13 showing the fastener and disc plate in a driven position secured to the insulated roof deck.

As seen in FIG. 2, the retractable barrel 6 and housing 4 are biased in an extended position by way of a coil spring 52 which engages the end 10 of the driving tool 8 at one end and the first end 24 of the barrel 6 at the other end. As seen in FIG. 2, coil spring 52 is positioned within the bore 12 of the housing 4 and it can be appreciated that when an axial force is applied to the housing by way of the driver tool 8, the spring 52 compresses, permitting relative movement between the barrel 6 and the housing 4. As such movement occurs, the driver head 8 moves within the barrel bore toward the plate retaining member 00 to eventually engage the head 45 of the fastener combination 40 previously inserted therein. Continued downward pressure applied to the driver tool 8 along with the driver tool induced rotation of the fastener 44 causes continued descent of the driver head 8 to set the fastener in the workpiece as shown in FIGS. 12–14.

Figure 5:
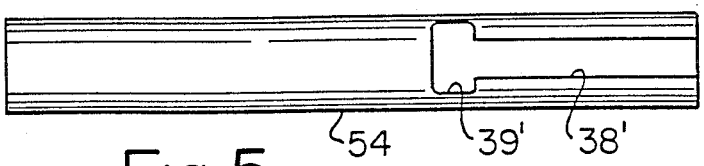
FIG. 5 is a side elevation view of a steel barrel insert.
Figure 6:
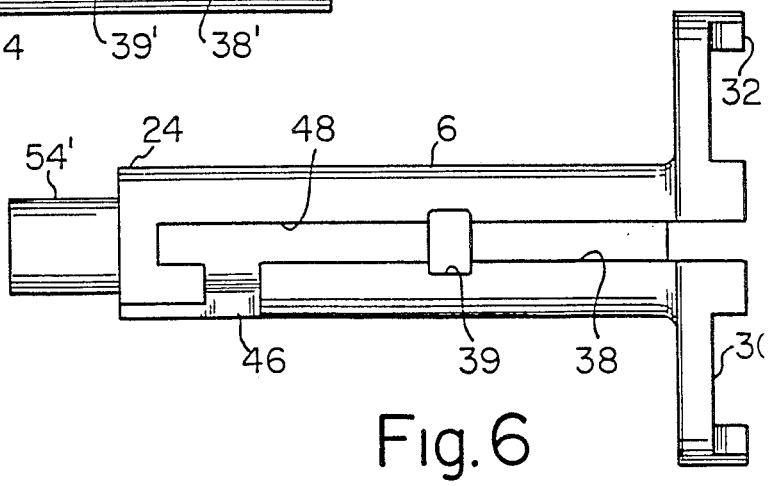
FIG. 6 is a side elevation view of the barrel assembly similar to FIG. 3 but at a 90° rotation therefrom.

In order to decrease the weight and cost of the device, the barrel 6 may be constructed of a plastic material, such as, for example, a high strength glass-filled nylon material. In such a construction, however, it may be advisable to include a wear resistant steel insert 54 to form the bore of the barrel 6. Steel barrel insert 54 may conveniently be inserted in an injection molding die at the time the barrel 6 is molded. The barrel insert 54 has an axial bore 56 which is of a dimension slightly greater than that of the fastener head 45 whereby the bore 56 acts as a sliding guide for head 45 to insure axial alignment of the fastener 44 during insertion of the fastener assembly 40. It will be appreciated that the steel insert 54 will present a more wear resistant surface than a plastic bore surface so as to yield a longer service life with accurate alignment capabilities. As seen in FIG. 5, steel barrel insert 54 also has a slot 38′ and an enlarged head portion 39′ formed through a side wall thereof and positioned in registry with the slot 38 and enlarged portion 39, respectively, of the barrel 6 to permit the side entry of a fastener 44 of a fastener plate combination 40 therethrough. An upper end portion 54′ of the steel barrel insert extends beyond the first end 24 of the barrel 6, FIG. 6, and forms a convenient bearing post for the coil spring 52, FIG. 2.

Figure 11:
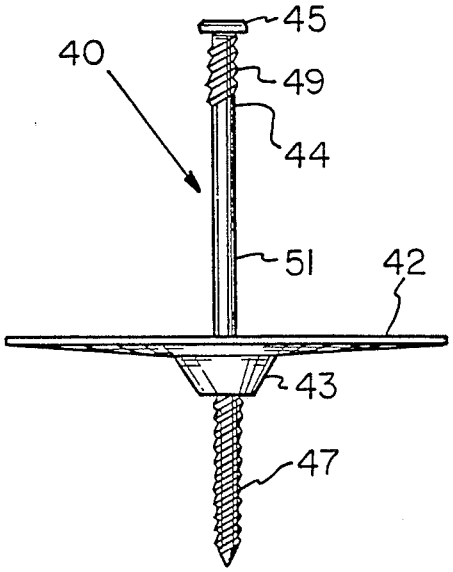
FIG. 11 is a side elevation view of a preassembled elongated threaded fastener and stress plate combination.
Figure 10:
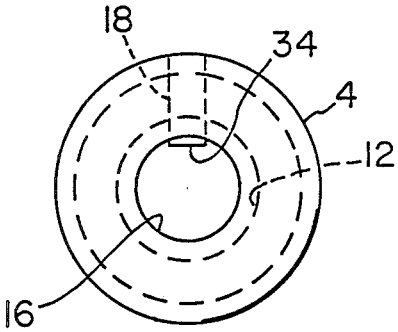
FIG. 10 is a top plan view of the housing member.

In the practice of a preferred method according to the present invention, the elongated threaded fasteners 44 and disc-like stress plates 42 are pre-assembled into the fastener-plate combination 40 shown in FIG. 11 prior to insertion into my barrel assembly 2. This pre-assembly operation is preferably done prior to delivery to the job site so that the workmen need only handle the pre-assembled fastener-plate combinations 40 rather than the loose fasteners 44 and separate discs 42 commonly employed in prior conventional installation methods. The known stress plate 42 is generally a flexible plastic material such as dense polypropylene or polyethylene material and includes a generally planar body having a centrally located hub portion 43 depending from a lower surface of the body. Anti-rotational means may extend from the bottom of the plate to engage the insulation and prevent back rotation of the assembly after setting. The elongated fastener 44 is also conventional and may contain threads along substantially its entire shank length or it may contain a lower threaded shank portion 47 and upper threaded shank portion 49 with an unthreaded shank portion 51 therebetween of a diameter substantially equal to that of the threaded pitch diameter of the upper and lower portions 49 and 47. The elongated fastener 44 is preassembled within the stress plate 42 to a predetermined spatial relationship between the fastener head and the top of the plate. This relationship coordinates with the slot length in the tool barrel and permits the fastener to be engaged by the driver when the plate is fixed within the tool. The fastener is generally in frictional engagement with the bore of the hub of the stress plate. In this manner the longitudinal axis of the fastener 44 is substantially perpendicular to the plane defined by the stress plate 42. In practice, the head of the fastener is normally on the order of 2 inches above the upper plane of the stress plate.

Figure 7:
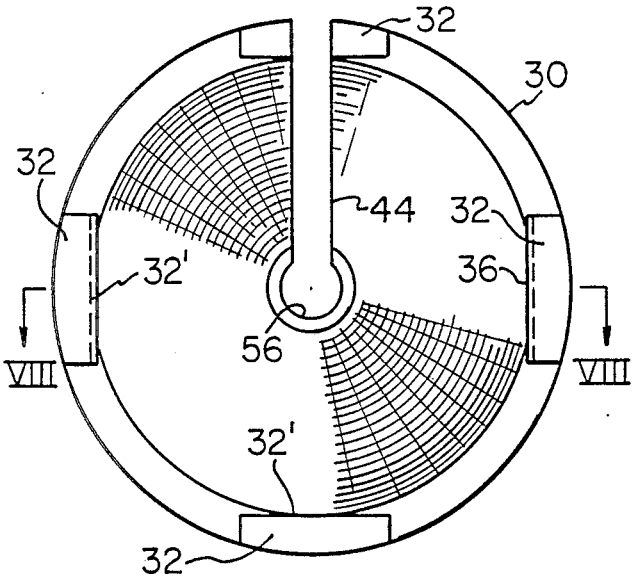
FIG. 7 is a bottom plan view of the stress plate retaining member of the barrel assembly.

The stress plate preferably contains flat edge portions 42' spaced at 90° intervals around its periphery, FIG. 1. These flat portions 42' engage flat surfaces 32' of the locator projections 32, FIGS. 7–8, whereby rotation of plate 42 is prevented as the fastener 44 is being driven.

In use, the pre-assembled fastener and disc combination 40 is either side inserted through slot 38 within the barrel assembly 2, as shown in FIG. 1, or bottom inserted directly into the discharge end of the barrel bore as previously described. The pre-assembled fastener plate combination 40 is held in an axially aligned position within the barrel assembly 2 by virtue of the fact that the plate 42 is secured by the locking fins 36 of the retaining member 30. Lateral movement of the shank of the fastener 44 is prevented since the shank is threadably secured within the hub 43 of the locked stress plate 42. Thus, after insertion, the stress plate 42 functions as an integral part of the barrel assembly to guide and align the elongated fastener 44. Perpendicular, aligned driving of the fastener 44 is thus obtained by virtue of the fact that the head 45 of the fastener is slidably guided within the barrel bore 56 while the shank is laterally stabilized by locked stress plate hub 43, FIG. 12. As the driving head of the tool 8 engages the head 45 of the fastener and rotatably drives it downwardly within the barrel assembly 2, the relative locked alignment of the stress plate hub 43 and fastener head 45 results in the elongated fastener 44 being driven in a true perpendicular orientation relative to the plane of the roof deck 50. As seen in the driving sequence of FIGS. 12–14, the fastener 44 proceeds downwardly through a layer of insulation 58 until its lower end engages a metal roof deck plate 60. In one common type of fastener system employed in FIGS. 12–14, the fastener 44 has an unthreaded upper shank portion 62 at the headed end of the fastener. When the pointed end of the fastener 44 begins to penetrate the steel decking 60, there is a certain dwell time until the surface is pierced. During this dwell time as the fastener 44 rotates, the plate 42 and retaining member 30 of the barrel 6 commence to move away from the roof 50 as the plate 42 rides up the fastener shank. This upward float of the barrel 6 continues until the hub 43 of the plate 42 reaches the unthreaded shank portion 62 of the screw, FIG. 13. The threads previously formed in the bore of the hub 53 of the plastic plate are therefore not stripped as the fastener 44 taps through the steel deck lo 60 and reaches its maximum setting depth shown in FIG. 14. It is important to avoid thread stripping in the hub 43 so as to maintain a firm fit between the top thread of the fastener and the plate hub thread. In this manner, forces applied to the plates such as by workmen's feet or rolling equipment do not cause the fastener heads to pop upwardly through the later applied plastic membrane sheet roof covering.

Hence, it is appreciated that the pre-assembled units 40 are much easier to handle on the job site compared with the prior loose fasteners and stress plates of previous conventional methods. Over driving of the fastener and stress cracking of the plate from overdriving or poor alignment is also eliminated. Installation speed is improved and the tool is easily adapted to varying job situations. The initial setting tool costs are greatly reduced and maintenance problems greatly alleviated.

Having thus described my invention with the detail and particularity required by the Patent Laws, what is claimed and desired protected by Letters Patent is set forth in the following claims.

What is claimed is:

1. In combination, an improved barrel assembly and a fastener unit, wherein a portion of the fastener unit forms a part of the barrel assembly, suitable for use with a fastener driver tool of the type having a tool body and a driver, said fastener unit comprising a stress plate having an elongated threaded fastener pre-assembled through a central opening in the plate and frictionally held thereto said combination comprising:

a. a housing adapted for attachment at one end to the tool body;

b. a barrel member having a through bore slidably connected at a first end to the housing, and including a second end carrying means to retain said pre-assembled stress plate therein with the fastener extending within the bore and a headed portion of the fastener being spaced from the stress plate;

c. said pre-assembled stress plate in a first position lockably secured within the retaining means of the barrel so as to form a temporary part thereof, whereby said locked stress plate forms an alignment guide for said elongated fastener to rigidly maintain an axial alignment of said fastener relative to the stress plate while said fastener is being driven by said driver tool into a workpiece; and d. biasing means associated with the barrel member and housing to urge said barrel member into an extended position relative to said housing and to permit retractive movement of said barrel movement while said fastener is being driven until said pre-assembled stress plate and fastener unit reaches a second position in which the stress plate is removed from the second end carrying means and said unit is secured to the workpiece and said carrying means is adapted to receive a next fastener unit in said first position.

2. The combination of claim 1 wherein the stress plate retention means of the barrel comprises an enlarged disc-shaped portion carrying a plurality of outwardly depending locator projections around an outer perimeter thereof defining segments around a circumference substantially equal to a circumference described by the stress plate, at least one of said projections carrying a locking fin adapted to detachably engage a perimeter edge portion of the stress plate to retain said stress plate while the fastener is driven.

3. The combination of claim 1 wherein the housing and barrel member are constructed of a molded plastic material and includes a metal insert forming the bore of the barrel member.

4. The combination of claim 1 wherein the stress plate is constructed of a plastic material and the headed portion of the pre-assembled elongated fastener extends above the hub stress plate distance of about two inches.

5. A method of driving a stress plate and elongated threaded fastener combination into a workpiece comprising:

a. pre-assemblying an elongated fastener and stress plate whereby the fastener is threadably inserted into a hub portion of said stress plate a distance of at least about one-quarter of the fastener length;

b. inserting the pre-assembled plate and fastener into a barrel of a driver tool;

c. guiding the head of the fastener within the tool barrel and holding the stress plate at a plate holder portion of said barrel to establish a rigid perpendicular alignment between said fastener and stress plate;

d. driving the fastener into the workpiece while maintaining said perpendicular alignment of the fastener relative to said stress plate; and e. removing the tool from the driver fastener and stress plate after said fastener is driven.

6. The method of claim 5 including the step of retracting said plate holder portion and barrel during said driving step when said fastener is penetrating a metal deck of said workpiece, whereby said stress plate is permitted to move upwardly along said fastener to an unthreaded area thereon to avoid thread stripping within the hub portion of said stress plate.

7. The method of claim 5 wherein the pre-assembled stress plate and fastener combination is inserted through a slot formed in the side of the tool barrel.

8. The method of claim 5 wherein the pre-assembled stress plate and the fastener combination is inserted into an end of the tool barrel at the plate holder portion thereof.

9. A method of driving a stress plate and elongated threaded fastener combination into a workpiece comprising:

a. pre-assemblying an elongated fastener and stress plate whereby the fastener is inserted into a central opening through the stress plate and frictionally held thereto a distance of at least about one-fourth of the fastener length;

b. inserting the pre-assembled plate and fastener into a barrel of a driver tool;

c. guiding the head of the fastener within the tool barrel and holding the stress plate at a plate holder portion of said barrel to establish a rigid perpendicular alignment between said fastener and stress plate;

d. driving the fastener into the workpiece while maintaining said perpendicular alignment of the fastener relative to said stress plate; and e. removing the tool from the driver fastener and stress plate after said fastener is driven.

* * * * *

UNITED STATES PATENT AND TRADEMARK OFFICE

CERTIFICATE OF CORRECTION

PATENT NO. : 4,809,568

DATED : March 7, 1989

INVENTOR(S) : Charles J. DeCaro

It is certified that error appears in the above-identified patent and that said Letters Patent is hereby corrected as shown below:

In the Abstract Line 3 "attachement" should read --attachment--.

Column 2 Line 11 after "elongated" delete -- , --.

Column 4 Line 38 "a" should read --an--.

Column 5 Line 25 "preassembled" should read --pre-assembled--.

Column 6 Line 12 "00" should read --30--.

Column 6 Line 68 "preassembled" should read --pre-assembled--.

Column 7 Line 59 before "60" delete --lo--.

UNITED STATES PATENT AND TRADEMARK OFFICE

CERTIFICATE OF CORRECTION

PATENT NO. : 4,809,568

DATED : March 7, 1989

INVENTOR(S) : Charles J. DeCaro

It is certified that error appears in the above-identified patent and that said Letters Patent is hereby corrected as shown below:

Claim 4 Column 8 Line 65 "hub stress plate distance" should read --stress plate a distance--.

Column 9 is "Double Spaced" should be --Single Spaced--.

Claim 6 Column 9 Line 20 after "whereby" insert --,--.

Claim 9 a) Column 10 Line 14 "one-fourth" should read --one-quarter--.

Signed and Sealed this

Fourteenth Day of November, 1989

*Attest:*

JEFFREY M. SAMUELS

*Attesting Officer* *Acting Commissioner of Patents and Trademarks*